US006200427B1

(12) United States Patent
Kotitschke et al.

(10) Patent No.: US 6,200,427 B1
(45) Date of Patent: Mar. 13, 2001

(54) SUCTION ROLL FOR THE FORMATION OR TREATMENT OF A MATERIAL WEB, SUCH AS IN PARTICULAR A PAPER, CARD OR TEXTILE WEB

(76) Inventors: Gerhard Kotitschke, Mittelrain 37, Steinheim D-89555; Wolfgang Mayer, Uracher Weg 10; Hans-Peter Sollinger, Germanenstrase 161, both of Heidenheim D-89522; Klaus Esslinger, Schulstrasse 9/1, Nattheim D-89564; Andreas Meschenmoser, Happenweiler 204, Horgenzell D-88263, all of (DE); Günther Mohrhardt, Apto. 1408, Avenida Dr. Silva, Melo, 132 Jardim Marajoara, Sao Paulo (BR); Peter Mirsberger, Panoramastr. 69, Baienfurt D-88255 (DE)

( * ) Notice: Subject to any disclaimer, the term of this patent is extended or adjusted under 35 U.S.C. 154(b) by 0 days.

(21) Appl. No.: 09/147,710

(22) PCT Filed: Aug. 22, 1997

(86) PCT No.: PCT/EP97/04586

§ 371 Date: Jun. 30, 1999

§ 102(e) Date: Jun. 30, 1999

(87) PCT Pub. No.: WO98/07923

PCT Pub. Date: Feb. 26, 1998

(30) Foreign Application Priority Data

Aug. 22, 1996 (DE) ..... 196 33 958

(51) Int. Cl.[7] ..... D21F 3/00

(52) U.S. Cl. ..... 162/360.2; 162/363; 162/368; 162/205; 162/DIG. 7; 34/114; 34/115; 34/117; 29/121.1

(58) Field of Search ..... 162/360.2, 363, 162/368, 205, DIG. 7; 34/114, 115, 117; 29/121.1

(56) References Cited

U.S. PATENT DOCUMENTS

| | | | | |
|---|---|---|---|---|
| 4,172,759 | | 10/1979 | Kankaanpää | 162/205 |
| 4,447,941 | * | 5/1984 | Schnell | 29/121.1 |
| 4,974,340 | * | 12/1990 | Wedel | 34/115 |
| 5,076,894 | * | 12/1991 | Simmons | 162/352 |

FOREIGN PATENT DOCUMENTS

| | | |
|---|---|---|
| 227223 | 7/1909 | (DE) . |
| 1156304 | 10/1963 | (DE) . |
| 2364291 | 4/1978 | (FR) . |

* cited by examiner

*Primary Examiner*—Stanley S. Silverman
*Assistant Examiner*—Mark Halpern

(57) ABSTRACT

Suction roll for the formation or treatment of a material web that includes an outer suction roll jacket comprising a perforated rotating hollow cylinder, a non-perforated support body arranged to extend through the outer suction roll jacket and to support the outer suction roll jacket at at least one point of its axial extent, and sealing ribs arranged to extend radially between the support body and the suction roll jacket and axially over a full length of the suction roll jacket. In this manner, the support body is adapted to rotate at a same speed as the suction roll jacket. The support body can include an axially extending, through-going bore arranged concentrically with the outer suction roll surface. An axially extending, rotationally fixed yoke extends through the through-going bore, and the rotationally fixed yoke has two ends which are supported outside of the support body on a frame. At least one support element is arranged to support the support body on the yoke. In this way, a bending line of the support body is capable of being influenced.

45 Claims, 5 Drawing Sheets

SUCTION ROLL FOR THE FORMATION OR TREATMENT OF A MATERIAL WEB, SUCH AS IN PARTICULAR A PAPER, CARD OR TEXTILE WEB

CROSS-REFERENCE TO RELATED APPLICATIONS

The present invention is a U.S. National Stage application of International Application No. PCT/EP97/04586 filed Aug. 22, 1997, which claims priority under 35 U.S.C. § 119 of German Patent Application No. 196 33 958.8, filed Aug. 22, 1996.

BACKGROUND OF THE INVENTION

1. Field of the Invention

The invention relates to a suction roll for the formation or treatment of a material web, such as, in particular, a paper, card or textile web. The suction roll includes an outer suction roll jacket formed by a perforated, rotating, hollow cylinder and a non-perforated support body which passes through the suction roll jacket. The suction roll jacket is supported on the support body, at at least one point of its axial extent, in particular against its own weight, against the suction force, against the tensile force of an outer, recirculating belt, and/or against a pressing force acting from the outside.

2. Discussion of Background Information

The previously known suction rolls of this kind have, among other things, the disadvantage that the line force is restricted to a relatively low value. These rolls are thus, for example, not suitable for use in connection with deflection compensated rolls.

In a suction roll of the initially named kind known from DE-C-227223 in which a plurality of longitudinal cells subjected to axial suction are formed between a screen-like perforated outer jacket and an inner jacket, the inner jacket is secured by spiders and hubs to a rotating shaft.

In FR-A-2364291 a roll subjected to suction from the outside is described which includes a hollow, deflection compensated cylinder which is supported via a sliding shoe on an inner stationary carrier, which has through-going radial bores with a relatively large spacing from one another which communicate with longitudinal grooves. The roll is also provided with an outer jacket having longitudinal grooves which communicate with those of the deflection compensated cylinder, and thus with the inner space of the deflection compensated cylinder. In another embodiment of a roll subjected to suction from the outside, known from this FR-A-236429 1, a non-perforated roll jacket provided with grooves is supported via a pressure medium chamber on an inner stationary carrier.

SUMMARY OF THE INVENTION

The object of the invention is to provide a suction roll of the initially named kind which can be used without problem, in particular also in connection with associated deflection compensated rolls, and -which is in particular also suitable for the production of higher pressing forces. Moreover, the suction roll should be capable of being used in advantageous manner, in particular also as a suction breast roll, or forming roll or screen suction roll.

This object is satisfied in accordance with the invention in a suction roll having sealing ribs which extend radially between the support body and the suction roll jacket, and also axially over the full length of the suction roll jacket. The support body has an axially extending, throughgoing bore concentric to the outer suction roll surface. An axially ex-tending, rotationally fixed yoke passes through this bore, and is supported at its two ends outside of the support body on a frame. The support body is supported at the yoke by at least one hydrostatic and/or hydrodynamic support element, with it preferably being possible to influence the bending line of the support body.

An alternative solution proposed by the invention for a suction roll without ribs is characterized in that the support body has a right cylindrical outer contour and also a through-going axial bore concentric to the latter. An axially extending, rotationally fixed yoke passes through this bore and is supported at its two ends outside of the support body on a frame. The support body is supported at the yoke by at least one, preferably hydrostatic and/or hydrodynamic support element on the yoke, and it is preferably possible to influence the bending, line of the support body. The support body eccentrically contacts the inner circumference of the suction roll jacket. The outer circumferential speed of the support body is at least substantially the same as the inner circumferential speed of the suction roll jacket.

As a result of this design, significantly higher pressing forces can be produced with a minimum effort. In particular, it is also possible to associate one or more shoe pressing units with the suction roll, by which a higher line force can, if necessary, be achieved and which can in particular lie above 200 kN /m. Moreover, the suction roll of the invention can in particular also be used as a suction breast roll or as a forming suction roll or as a screen suction roll. Advantageous possibilities of use thus also result, in particular in conjunction with the formation of pressure zones in forming cylinders. Moreover, with this enlarged scope of use in the forming region, the screen tensions and the associated roll deflection and the adjustment of the screen tension and of the screen running length, which may be possible by a Nipco control (deflection compensated roll) can be taken into account over the full machine width.

With respect to the second alternative, the advantages named in the following also result, amongst other things. Thus, a high loadability is achieved as a consequence of the direct support of the jacket, above all with broad, broad-nip counter-rolls, and the line force can, for example, be larger than 200 kN/m. Through the zone control, a regulatable deflection or contour of the nip profile is possible, due to direct support with a flexible jacket of the support body formed by a Nipco or deflection compensated roll and also a more flexible suction roll jacket. Since the suction roll jacket can have a thinner wall thickness as a result of the direct support without ribs, the suction roll jacket is less expensive in total. Moreover, because less hole air has to be pumped away as a consequence of the lower wall thickness of the suction roll jacket, lower energy costs arise for the vacuum to be produced. The manufacturing costs are further reduced in that a less expensive Nipco jacket can also be used for the support body in addition to the thin suction roll jacket, and no form of ribs or other webs are necessary between the suction roll jacket and the support body.

With the ribs which are provided in the first alternative, a type of cellular suction roll arises, and end face suction and/or also a different type of suction can be provided. The support body is in particular supported by the different deflection compensated rolls.

In an embodiment of the suction roll of the invention formed in accordance with the first alternative, which is referred in practice, at least one, non-rotating connection is provided. At least at one roll end, with sectors formed between the suction roll jacket and the support body by the ribs alternately lying opposite to the connection as a consequence of the rotation of the roll. The sector or sectors which respectively lie opposite to the non-rotating connection is sealed relative to the connection, and is connected via the latter to a pressure or vacuum source, so that different pressures result for the sectors spread about in the circumferential direction.

In certain cases a non-uniform suction can consciously be provided over the width. Thus, it can in practice, for example, transpire that suction only takes place at the edge. Moreover, an external suction can be provided in combination with end face or internal suction.

In an expedient embodiment, the sectors formed by the ribs between the suction roll jacket and the support body are subdivided in the direction of the roll axis by at least one radially extending partition wall into at least two axial sections, which can be separately subjected to pressure.

In certain cases, it is expedient if at least one non-rotating connection is respectively provided at the two roll ends. If the sectors are subdivided in the direction of the roll axis by at least two axially spaced apart partition walls, at least three axial sections can be separately subjected to pressure. In this connection, it is expedient if the sectors formed between the suction roll jacket and the support body in at least one axially central roll zone are connectable via connection lines to a pressure or vacuum source, which are led radially within the sectors in the direction of the roll axis axially towards the outside.

Alternatively, it is conceivable that sectors formed in at least one axially central roll zone between the suction roll jacket and the support body are connectable to a pressure or vacuum source via a pressure or suction box that partly surrounds the suction roll jacket from the outside. In this arrangement the at least one axially central roll zone can be formed in all sectors without sealing ribs extending in the axial direction of the roll.

In certain cases, it can be expedient if the support body is supported by a plurality of support elements or support element rows in a plurality of radial directions on the support body.

Moreover, in certain applications, it is advantageous if the support body, together with the suction roll jacket, is radially displaceable as a whole, through a corresponding stroke movement, to enable a placement at and/or pressing against a counter-surface, preferably formed by a counter-roll. For this purpose seals can be provided at the roll ends, which permit a joint stroke movement of the support body and of the suction roll jacket, with the direction of the stroke movement preferably coinciding with the direction of action of the resultant load and of the at least one internal support element arranged between the yoke and the support body, and with at least one support element moveable stroke-wise being provided between the fixedly mounted yoke and the support body.

In an expedient embodiment of the suction roll of the invention formed in accordance with the second alternative, the radial direction of action of the at least one support element arranged between the yoke and the support body coincides at least substantially with the direction in which the rotating support body is applied against the inner circumference of the suction roll jacket, and at least substantially also coincides with the direction in which the resultant load due to self-weight, the tensile force of an outer band and/or an outer pressing force acts on the suction roll jacket.

In certain applications, it is expedient if the suction roll jacket is at least partly surrounded from the outside by a pressure box or suction box, to subject the space between the suction roll jacket and the support body, including the radial bores provided in the suction roll jacket, to pressure.

The space between the suction roll jacket and the support body can be subdivided by at least one stationary partition wall extending in the direction of the roll axis and sealed relative to the inner circumference of the suction roll jacket into at least two axial chambers. At least one chamber is connected via a connection at at least one roll end to a pressure source.

In this respect, it is in certain cases expedient if the support body does not contribute over its entire axial length to the subdivision of the specific space into at least two axial chambers. Alternatively, the support body can, however, also contribute over its axial length to the subdivision of the relevant space into at least two axial chambers and cooperate through resilient sealing elements with at least one partition wall.

The suction can thus, for example, take place axially via different chambers within the suction roll jacket or via an external. suction box, with a combination of these two embodiments also being conceivable. This can, in particular, be of interest if suction is to be intentionally applied and the water spray capture channel used for the suction action from the outside. In this connection the high occurrence of hole air at high machine speed is reduced, because the jacket bores are no longer exposed to the atmospheric pressure, i.e. were filled at normal air pressure, and must then be evacuated again. The advantages of a suction roll subjected to suction from the outside are thus in particular also exploited.

In an expedient embodiment the support body and the suction roll jacket are in particular radially displaceable relative to one another, in particular in the bearing regions at the roll ends, with seals permitting such a relative movement being provided in the region of these roll ends, and with the direction of the relevant relative stroke movement preferably coinciding with the direction of action of the resultant load and of the at least one internal support element arranged between the yoke and the support body.

In this arrangement separate elements can be provided in order, on the one hand, to place the suction roll jacket at or to press it against a counter-surface formed by a counter-roll and, on the other hand, to place the support body at or press it against the inner periphery of the suction roll jacket.

The device for the placement and/or pressing of the support body can include at least one support element movable stroke-wise arranged between the yoke and the support body and can be executed so that the support body can execute a stroke movement over its entire axial length.

The sealing can, in particular, take place in the manner which is also the case for deflection compensated rolls (Nipco rolls), with a jacket which is radially displaceable as a whole. Any possibly provided partition walls can, for example, be secured to the non-rotating side seals.

The support body can be provided at its outer surface with peripheral grooves, spirally extending grooves, raised portions, elevations, recesses and/or the like, lying in a respective radial plane, so that a discontinuous contact line or surface results between the support body and the internal circumference of the suction roll jacket. Alternatively, it is also conceivable that the suction roll jacket is provided at its internal circumferential surface, with such internal circumferential grooves, spirally extending grooves, raised portions, elevations, recesses and/or the like lying in a respective radial plane.

A layer of an elastic material, such as in particular plastic and/or the like, can be provided at the outside on the support body or at the inner side of the suction roll jacket in order to damp oscillations and/or to compensate for unevenness as a consequence of deposits. Moreover, it is conceivable that the support body includes an elastic material, such as rubber, plastic, plastic with reinforcements, such as in particular a spiral spring, or glass or carbon fibers, i.e. CFC/GFC and/or the like.

Both the suction roll of the invention formed in accordance with the first alternative, as well as the suction roll of the invention formed in accordance with the second alternative can, for example, form a press gap or broad nip extended in the web running direction, for example with at least one counter-surface. The respective counter-surface is formed by a shoe press unit, in particular a shoe press roll having at least one press shoe with a preferably concave pressing surface, in particular a shoe press roll including a rotating, flexible wall jacket.

In certain applications it can be expedient if the sucking action on the suction roll jacket takes place via at least one chamber-like sector within the suction roll jacket, and if at least one outer suction box is provided for the simultaneous sucking action on the suction roll jacket via the remaining jacket circumference in order to maintain a minimum vacuum in the radial bores of the suction roll jacket, with the outer suction box preferably also being provided for the catching and leading on of water spray.

The support body, which is built up in particular in the manner of a deflection-compensated roll, can be driven in the known manner for such controlled deflection rolls. The driving of the suction roll jacket can take place both via the support body formed by a deflection controlled roll and also via a felt counter-roll guided over the suction roll.

The covering over of bores provided in the suction roll jacket by the support body contacting it in the nip region and forming a kind of deflection compensated roll, is non-harmful because in the nip region no suction in any event takes place, since the bores are closed off by the outwardly contacting counter-surface, which is, for example, formed by a counter-roll and the roll can thus be considered at this point as being a blind bored roll.

The invention will be explained in more detail in the following with reference to embodiments and to the drawings, in which are shown:

DETAILED DESCRIPTION OF THE PRESENT INVENTION

Figure 1:
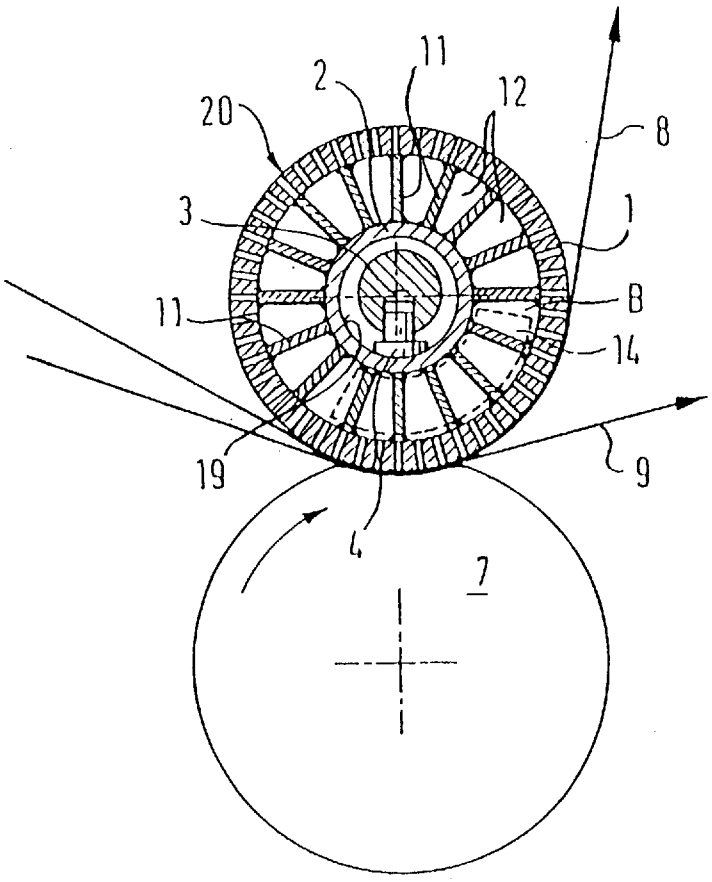
FIG. 1 a schematic cross-sectional view of a first embodiment of a suction roll with a support body coaxial to the roll axis and connected via ribs to the suction roll jacket, with the suction roll forming an extended press gap with a shoe press roll, FIG. 2 a schematic, longitudinally sectioned representation of the suction roll shown in FIG. 1, wherein a pressure or suction box associated with this roll can also be seen, FIG. 3 a schematic cross-sectional view of a further embodiment of a suction roll, with a support body eccentrically contacting the inner circumference of the suction roll jacket, with the suction roll forming an extended press gap with a shoe press roll, and a further press gap with a further counter-roll, FIG. 4 a schematic cross-sectional view of a further embodiment of a suction roll, with a support body contacting the inner circumference of the suction roll jacket, with the suction roll, which is surrounded by a felt, contacting a screen on the one side, and again forming an extended press gap with a shoe press roll on the other side, FIG. 5 a schematic cross-sectional view of a further embodiment of a suction roll, with a support body eccentrically contacting the inner circumference of the suction roll jacket, with the suction roll, which is surrounded by a felt, contacting a screen and forming an extended press gap with a shoe press roll, and also a further press gap with a further counter-roll, FIG. 6 a schematic, longitudinally sectioned partial view of the suction roll shown in FIG. 5, with the partition wall, which can be recognized in FIG. 5, having been omitted for the sake of clarity, and FIG. 7 a schematic cross-sectional view of a further embodiment of a suction roll used as a forming roll and having a support body which contacts the inner circumference of the suction roll jacket.

FIG. 1 shows, in a schematic cross-sectional view, a first embodiment of a suction roll 20 for the formation or treatment of a material web, in the present case of a paper web.

The suction roll 20 comprises an outer suction roll jacket 1 formed by a perforated, rotating hollow cylinder, a non-perforated support body 2, which passes through the suction roll jacket 1 and on which the suction roll jacket 1 is supported at at least one point of its axial extent, in particular against its own weight, against the suction force, against the tensile force of an outer recirculating belt 8, 9 and/or against a pressing force acting from the outside, as well as sealing ribs 11 which extend radially between the support body 2 and the suction roll jacket 1 and also axially over the full length of the suction roll jacket, via which the support body 2, which is concentric to the suction roll jacket 1 and rotates with the same speed as the latter, is firmly connected to the suction roll jacket 1.

The weld beads illustrated in FIG. 1 between the ribs 11 and the suction roll jacket 1 and the support body 2 are to be seen symbolically for a solid mounting between these elements, which can basically also be realized in different manner.

Figure 2:
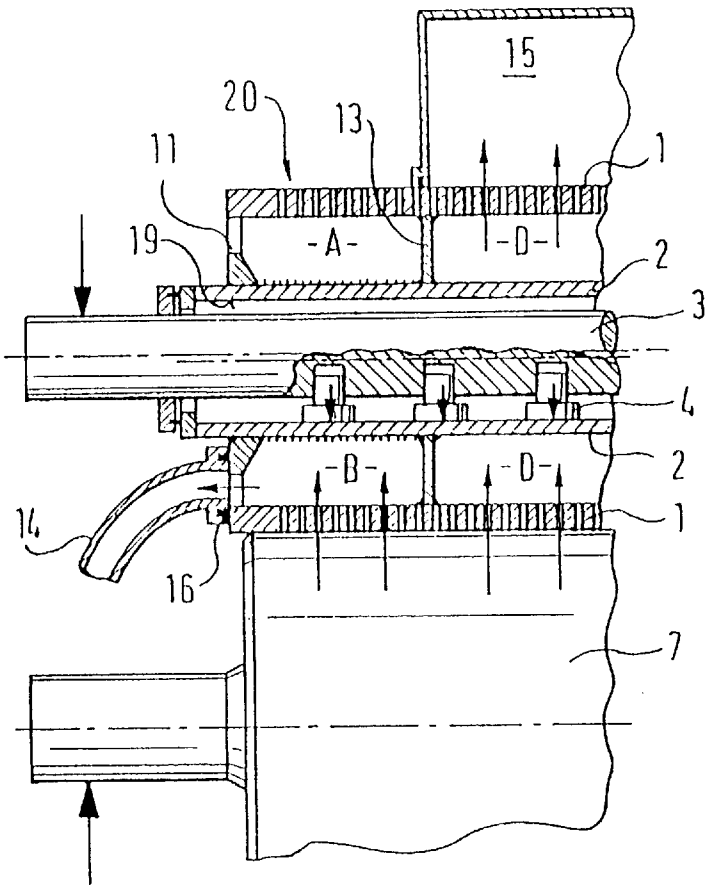

As can be seen in particular also with reference to FIG. 2, the support body 2 has an axially extending, through-going bore 19 concentric to the support body axis. An axially extending, rotationally fixed yoke 3 passes through this bore and is supported at its two ends outside of the support body 2 on a frame of the relevant paper machine.

The support body 2 is supported by a plurality of preferably hydrostatic and/or hydrodynamic support elements 4 on the yoke 3. It is preferably possible for its bending line to be influenced.

As can be seen with respect to FIGS. 1 and 2, at least one non-rotating connection 14 is provided at at least one roll end, and the sectors 12 formed by the ribs 11 between the suction roll jacket 1 and the support body 2 alternately lie opposite to the connection 14 as a consequence of the rotation of the roll, with the sectors 12 which respectively lie opposite to the non-rotating connection 14 being sealed relative to this connection and being connected via the latter to a pressure or vacuum source, so that different pressures result for the sectors 12 spread around the circumferential direction.

In accordance with FIG. 2, the sectors 12 formed by the ribs 11 between the suction roll jacket 1 and the support body 2 are subdivided in the direction of the roll axis by at least one radially extending partition wall 13 into at least two axial chamber-like sections A, B; D, which can be subjected separately to pressure. In the present case the sectors 12 are subdivided in the direction of the roll axis by two axially spaced apart partition walls 13 into three axial sections, which can be separately subjected to pressure, with it only being possible to recognize one of the two partition walls 13 in FIG. 2.

In accordance with FIG. 2, the sectors 12 (see also FIG. 1) formed between the suction roll jacket 1 and the support body 2 in the axially central roll zone D are connected via a pressure or suction box 15 to a pressure or vacuum source which partly surrounds the suction roll jacket 1 from the outside.

In the present case the axially central roll zone D is formed in all sectors 12, without ribs extending in the axial direction of the roll. The support elements 4 are arranged in a row parallel to the roll axis.

In the embodiment shown in FIGS. 1 and 2, the suction roll 20 forms an extended, double felted press gap in the web running direction of the paper web, with a shoe press roll 7 serving as a counter-roll. The two felts 8 and 9 guided through this extended press gap can be recognized in FIG. 1.

The support body 2 can be radially displaced as a whole, together with the suction roll jacket 1, in order to enable, through a corresponding stroke movement, placement at and/or pressure against the respective counter-surface.

Seals 16 (see in particular FIG. 2) are provided at the roll ends, which permit a joint stroke movement of the support body 2 and of the roll jacket 1. In this connection the direction of the stroke movement preferably coincides with the direction of action of the resulting loading, and with the inner support elements arranged between the yoke 3 and the support body 2. This stroke movement can, for example, be brought about by the support elements 4, which are moveable stroke-wise and provided between the fixedly mounted yoke 3 and the support body 2.

In FIGS. 3 to 7 there is in each case shown an embodiment of a suction roll 20 without ribs, in which the support body eccentrically contacts the inner circumference of the suction roll jacket 1.

The respective support body 2 has, in just the same way as in the previously described embodiment, a right cylindrical outer contour and also a through-going axial bore 19 concentric to the latter, with an axially extending, rotationally fixed yoke 3 passing through the bore and being supported at its two ends outside of the support body on a frame of the relevant paper machine. Moreover, the support body 2 is again supported on the yoke 3 by a plurality of preferably hydrostatic and/or hydrodynamic support elements 4, arranged in a row parallel to the roll axis, and it is preferably possible for the bending line of the support body to be influenced. The support body 2 is thus again formed in the manner of a deflection compensated roll. In this case the jacket of this support body 2, however, rolls loosely, i.e. without special mechanical attachment, in the suction roll jacket 1.

Figure 3:
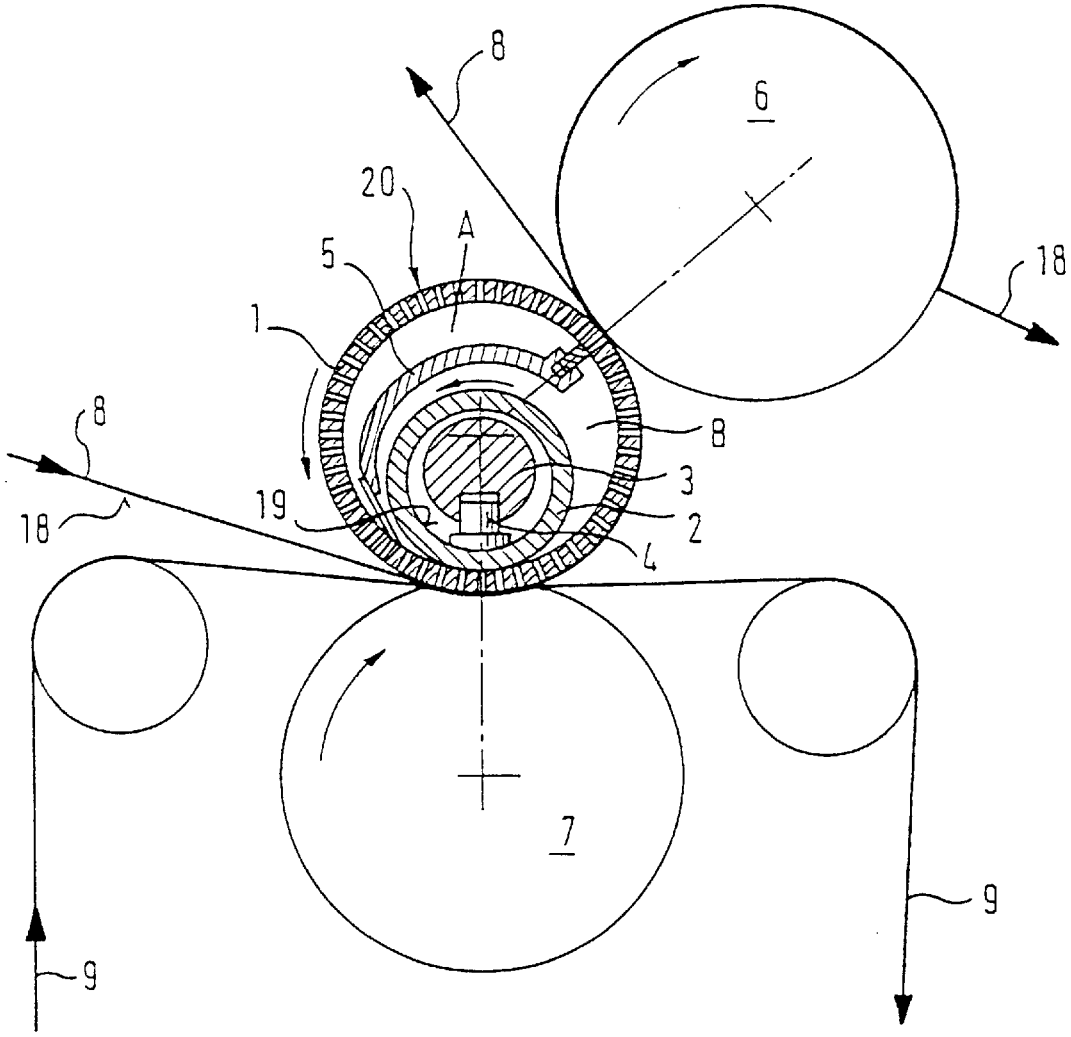

In the embodiment of FIG. 3, the suction roll 20 forms an extended press gap in the web running direction of the material web, with a shoe press roll 7, and the extended press gap is again double felted by the two felts 8, 9. Moreover, the suction roll 20 forms a further press gap, in this case a non-extended press gap, with a counter-roll 6 having a rigid roll jacket.

Figure 4:
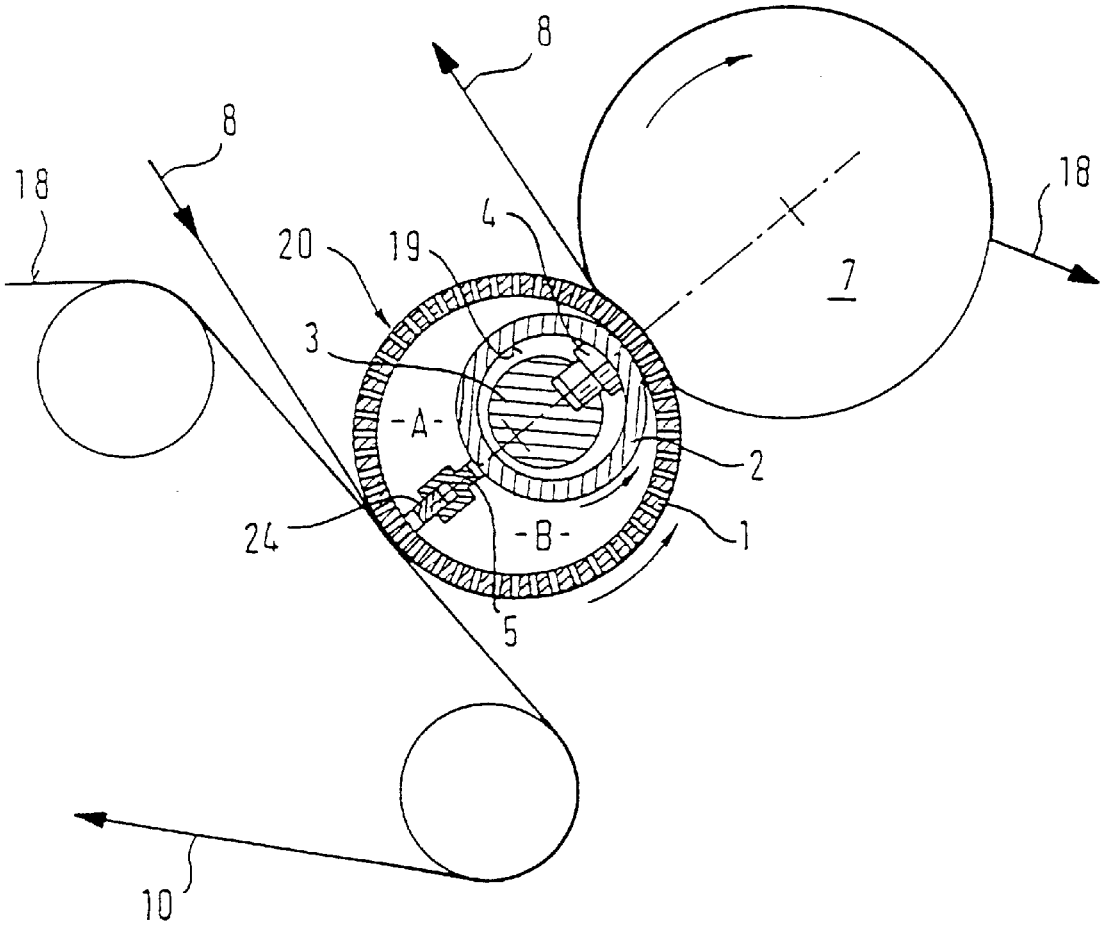

In the embodiment shown in FIG. 4 the suction roll 20, around which the felt 8 is wrapped, contacts, at one side, a screen 10 of a screen section, and, at the other side, a shoe press roll 7, with which it again forms a press gap extended in the web running direction of the material web.

Figure 5:
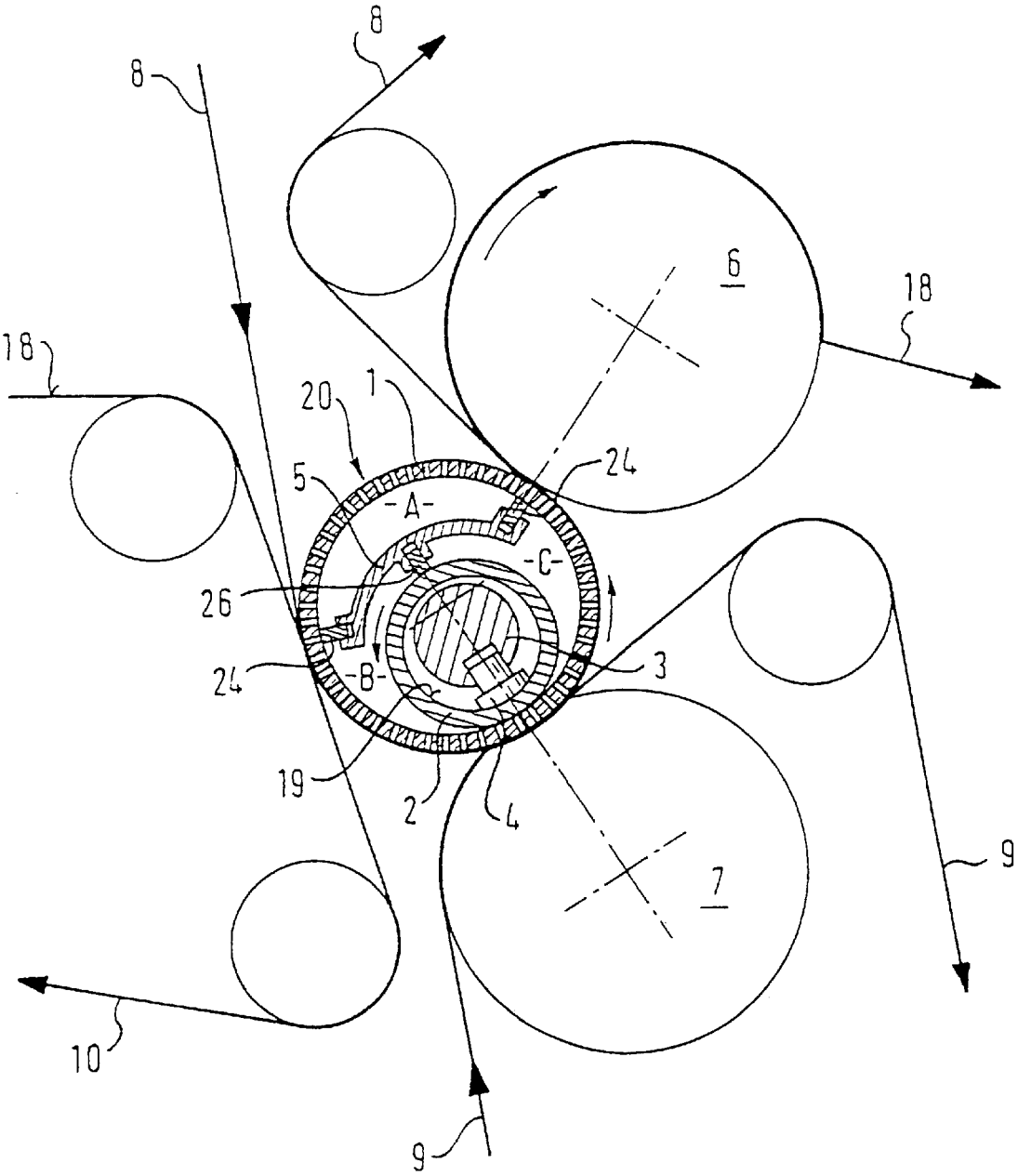

In the embodiment shown in cross-section in FIG. 5, the suction roll 20, around which a felt 8 is wrapped, again contacts a screen 10 of a screen section. It again forms a press gap extended in the web running direction of the material web, with a shoe press roll 7 surrounded by a felt 9, and the extended press gap is double felted by the two felts 8 and 9.

Figure 6:
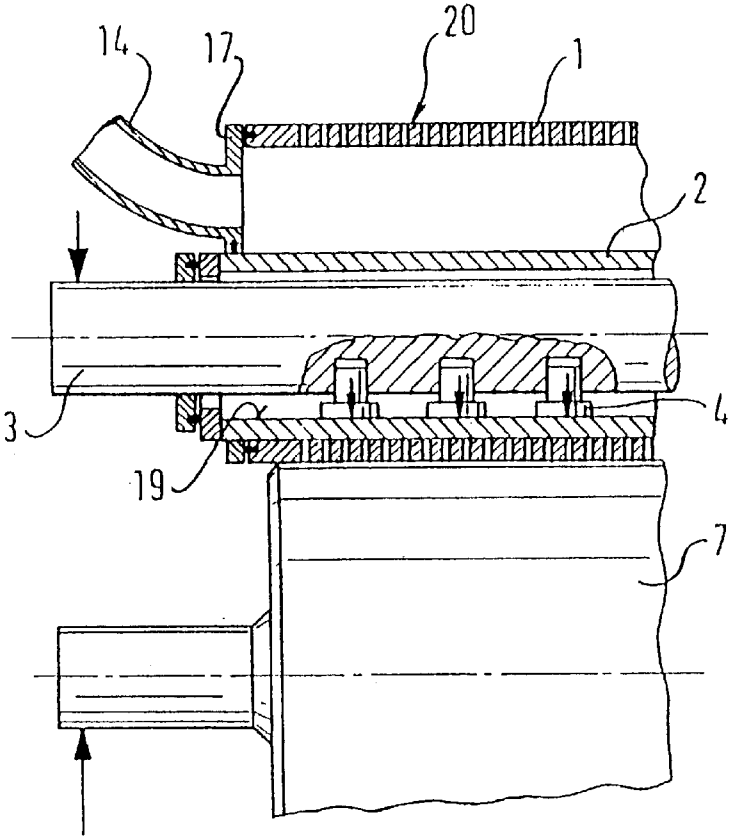

In FIG. 6 an end region of this suction roll 20 is shown in the longitudinal section.

Figure 7:
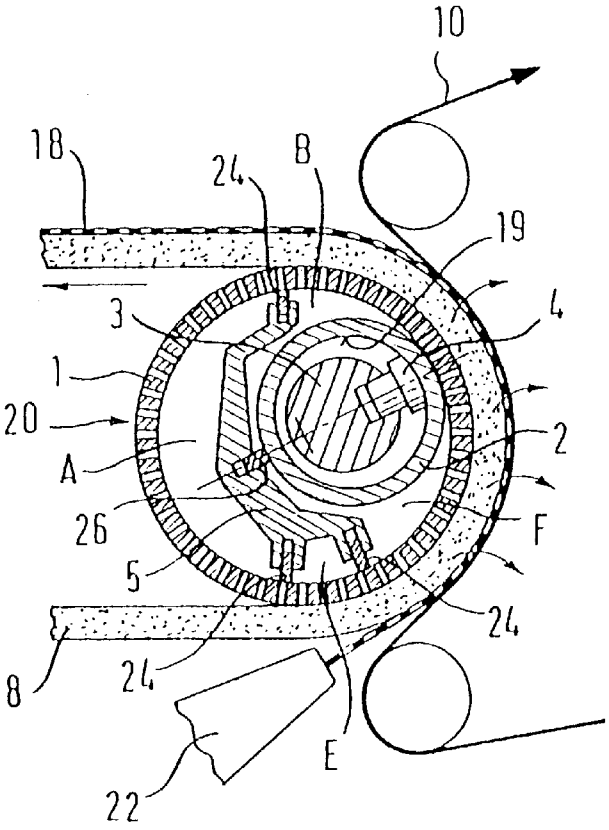

In the embodiment shown in FIG. 7 the suction roll serves as a forming roll, over which both the screen belt 8 and also the screen 10 is guided, with the fiber suspension delivered from a headbox 22 being introduced in the illustrated manner into the gap formed between the belt 8 and the screen 10. The material web 18 which is formed is then subsequently led on further with the belt 8.

In all the embodiments shown in FIGS. 3 to 7, the radial direction of action of the support elements 4 arranged between the yoke 3 and the support body 2 coincides with the direction in which the rotating support body 2 contacts the inner circumference of the suction roll jacket 1.

In the embodiments of FIGS. 3 to 5, it, moreover, coincides with the direction of action of the shoe press roll 7. In addition, the respective tension force of the belts 8, 9 and 10 is taken up by the support elements 4. This applies in particular also for the embodiment shown in FIG. 7, in which the suction roll 20 is used as a forming roll and the tension force of the belts 8 and 9 must be taken up by the support elements 4.

With the expanded use in the forming region shown in FIG. 7, it is also necessary to take account of the screen tensions, i.e. of the resulting roll deflection and the adjustment of the screen tension of the screen running lengths over the entire machine width made possible by the Nipco control.

The sealing between the support body 2 provided in the form of a deflection compensated roll, or Nipco roll, and the suction roll jacket 1 can be seen sketch-wise in FIG. 6. The partition walls 5 are secured to the non-rotating side seals 17 (see FIG. 6).

What is claimed is:

1. A suction roll for the formation or treatment of a material web comprising:

an outer suction roll jacket comprising a perforated rotating hollow cylinder;

a non-perforated support body arranged to extend through the outer suction roll jacket and to support the outer suction roll jacket at at least one point of its axial extent;

sealing ribs arranged to extend radially between the support body and the suction roll jacket and axially over a full length of the suction roll jacket, whereby the support body is adapted to rotate at a same speed as the suction roll jacket;

the support body comprising an axially extending, through-going bore arranged concentrically with the outer suction roll surface;

an axially extending, rotationally fixed yoke extends through the through-going bore;

the rotationally fixed yoke having two ends which are supported outside of the support body on a frame; and at least one support element arranged to support the support body on the yoke, whereby a bending line of the support body is capable of being influenced.

2. The suction roll in accordance with claim 1, further comprising one of a pressure and vacuum source coupled to at least one non-rotating connection;

the at least one non-rotating connection communicating with a plurality of sectors formed by the ribs between the suction roll jacket and the support body, wherein rotation of the roll moves the sectors relative to the at least one non-rotating connection, and wherein the plurality of sectors positioned opposite the at least one non-rotating connection is sealed relative to the connection and, thereby connected to the one of the pressure and vacuum source, whereby different pressures result for the sectors positioned around the circumferential direction.

3. The suction roll in accordance with claim 1, sectors formed by the ribs between the suction roll jacket and the support body are subdivided in an axial direction by at least one radially extending partition wall into at least two axial sections, which are adapted to be separately subjected to pressure.

4. The suction roll in accordance with claim 3, at least one respective non-rotating connection is provided at the two roll ends, and the sectors are subdivided in the axial direction by at least two spaced apart partition walls, into at least three axial sections, which are adapted to be separately subjected to pressure.

5. The suction roll in accordance with claim 4, the sectors formed between the suction roll jacket and the support body in an at least axially central roll zone are connectable to at least one of a pressure and vacuum source through connection lines that extend radially within the sectors and axially outwardly in the axial direction.

6. The suction roll in accordance with claim 4, the sectors formed between the suction roll jacket and the support body in at least one axially central roll zone are connectable to at least one of a pressure and vacuum source through at one of a pressure and suction box that at least partly surrounds the suction roll jacket from the outside.

7. The suction roll in accordance with claim 6, wherein the at least one axially central roll zone is formed in all sectors without sealing ribs extending in the axial direction of the roll.

8. The suction roll in accordance with claim 1, further comprising one of support row elements and a plurality of support elements that support the support body in a plurality of radial directions at the support body.

9. The suction roll in accordance with claim 1, wherein the support body is radially displaceable as a whole, together with the suction roll jacket, to provide a corresponding stroke movement against a counter-surface due to at least one of a placement and pressure against the counter-surface by a counter-roll.

10. The suction roll in accordance with claim 9, further comprising seals located at the roll ends that permit a joint stroke movement of the support body and the suction roll jacket, wherein the direction of the stroke movement coincides with a direction of a resulting load and of the at least one internal support element arranged between the yoke and the support body, and wherein the at least one internal support element is moveable stroke-wise between the yoke and the support body.

11. The suction roll in accordance with claim 1, wherein the support body is arranged to support the suction roll jacket against at least one of a weight of the suction roll jacket, a suction force, a tension force of an outer recirculating belt and an outside pressing force.

12. The suction roll in accordance with claim 1, wherein the support element is comprised of at least one of at least one of a hydrodynamic and a hydrostatic support element.

13. A suction roll for the formation or treatment of a material web, in particular of a paper, card or textile web, comprising:

an outer suction roll jacket comprising a perforated, rotating, hollow cylinder;

a non-perforated support body positioned to pass through the suction roll jacket and to support the outer suction roll jacket at at least one point of its axial extent;

the support body comprising a cylindrical, outer contour and a concentric axial bore;

a rotationally fixed yoke, having two ends, positioned to extend axially through the axial bore;

the yoke being supported at the two ends outside of the support body on a frame;

at least one support element arranged to support the support body on the yoke, whereby a bending line of the support body can be influenced; and the support body being eccentrically arranged within the suction roll jacket to contact against an inner circumference of the suction roll jacket, wherein an outer circumferential speed of the support body is at least substantially the same as an inner circumferential speed of the suction roll jacket.

14. The suction roll in accordance with claim 13, wherein a radial direction of movement of the at least one support element coincides at least substantially with a direction in which the rotating support body is applied against the inner circumference of the suction roll jacket, and at least substantially coincides with a direction in which a resultant load acts on the suction roll jacket.

15. The suction roll in accordance with claim 14, the resultant load comprising at least one of roll jacket weight, a tensile force applied by an outer belt and an external pressing force.

16. The suction roll in accordance with claim 13, further comprising one of a pressure and suction box positioned to at least partially surround the suction roll jacket from the outside, wherein a space between the suction roll jacket and the support body, as well as the radial bores provided in the suction roll jacket, is subjected to pressure.

17. The suction roll in accordance with claim 13, wherein a space between the suction roll jacket and the support body is subdivided in the radial direction by at least one stationary partition wall that extends in the axial direction, and is sealed, relative to the inner circumference of the suction roll jacket, into at least two axial chambers, wherein at least one of the at least two axial chambers is connected to a pressure source at the end of the roll through a connection.

18. The suction roll in accordance with claim 17, wherein the at least two axial chambers do not extend along a full axial length of the support body.

19. The suction roll in accordance with claim 17, further comprising a partition wall with sealing elements positionable within the space between the suction roll jacket and the support body, wherein the at least two axial chambers extend along a full axial length of the support body, and elastic sealing elements are provided to seal at least one partition wall.

20. The suction roll with claim 13, further comprising seals located in the region of the roll ends, the seals permitting relative movement, wherein the support body and the suction roll jacket are radially displaceable relative to one another in a bearing region at the roll ends, and the direction of a relevant relative stroke movement coincides with a direction of action of a resultant loading and of the at least one internal support element arranged between the yoke and the support body.

21. The suction roll in accordance with claim 20, further comprising positioning elements to place the suction roll jacket one of at and pressed against a counter-surface formed by a counter-roll and at least one of to place the support body at and pressed against an internal circumference of the suction roll jacket.

22. The suction roll in accordance with claim 21, the positioning elements comprising at least one support element movably arranged stroke-wise between the yoke and the support body, wherein the support body executes a stroke movement over its full axial length.

23. The suction roll in accordance with claim 1, further comprising at least one of circumferential grooves, spirally extending grooves, raised portions, elevations, and recesses arranged in a respective radial plane of an outer surface of the support body, wherein a discontinuous line of contact or surface results between the support body and the inner circumference of the suction roll jacket.

24. The suction roll in accordance with claim 1, further comprising at least one of internal peripheral grooves, spirally extending grooves, elevated portions, raised portions, and recesses lying in a respective radial plane of an inner circumferential surface of the suction roll jacket, wherein a discontinuous line of contact or surface results between the internal circumference of the suction roll jacket and the support body.

25. The suction roll in accordance with claim 1, further comprising a layer of an elastic material provided one of outwardly on the support body and at an inner surface of the suction roll jacket to dampen at least one of oscillations and unevenness due to deposits.

26. The suction roll in accordance with claim 25, the elastic layer comprising plastic.

27. The suction roll in accordance with claim 1, the support body being composed of an elastic material.

28. The suction roll in accordance with claim 27, wherein the elastic material comprises one of rubber, plastic, and plastic with reinforcements, wherein the reinforcements include a spiral spring, glass, and carbon fibers.

29. The suction roll in accordance with claim 28, the carbon fibers comprising CFC/GFC.

30. The suction roll in accordance with claim 1, arranged in combination with at least one counter-surface to form an extended press gap in a web-running direction, wherein the counter-surface is composed of a shoe press roll comprising a shoe pressing unit with at least one press shoe and a rotating flexible roll jacket.

31. The suction roll in accordance with claim 30, the at least one press shoe comprising a concave pressing surface.

32. The suction roll in accordance with claim 2, wherein a suction action of the suction roll jacket occurs through at least one chamber-like sector within the suction roll jacket;

wherein, for a simultaneous suction action on the suction roll jacket, at least one external suction box is provided over a substantially remaining portion of the periphery of the jacket to maintain a minimum vacuum in the radial bores of the suction roll jacket, wherein the outer suction box further provides for one of capturing and leading away of water spray.

33. The suction roll in accordance with claim 13, further comprising at least one of circumferential grooves, spirally extending grooves, raised portions, elevations, and recesses arranged in a respective radial plane of an outer surface of the support body, wherein a discontinuous line of contact or surface results between the support body and the inner circumference of the suction roll jacket.

34. The suction roll in accordance with claim 13, further comprising at least one of internal peripheral grooves, spirally extending grooves, elevated portions, raised portions, and recesses lying in a respective radial plane of an inner circumferential surface of the suction roll jacket, wherein a discontinuous line of contact or surface results between the internal circumference of the suction roll jacket and the support body.

35. The suction roll in accordance with claim 13, further comprising a layer of an elastic material provided one of outwardly on the support body and at an inner surface of the suction roll jacket to dampen at least one of oscillations and unevenness due to deposits.

36. The suction roll in accordance with claim 35, the elastic layer comprising plastic.

37. The suction roll in accordance with claim 13, the support body being composed of an elastic material.

38. The suction roll in accordance with claim 37, wherein the elastic material comprises one of rubber, plastic, and plastic with reinforcements, wherein the reinforcements include a spiral spring, glass, and carbon fibers.

39. The suction roll in accordance with claim 38, the carbon fibers comprising CFC/GFC.

40. The suction roll in accordance with claim 13, arranged in combination with at least one counter-surface to form an extended press gap in a web-running direction, wherein the counter-surface is composed of a shoe press roll comprising a shoe pressing unit with at least one press shoe and a rotating flexible roll jacket.

41. The suction roll in accordance with claim 40, the at least one press shoe comprising a concave pressing surface.

42. The suction roll in accordance with claim 16, wherein a suction action of the suction roll jacket occurs through at least one chamber-like sector within the suction roll jacket;

wherein, for a simultaneous suction action on the suction roll jacket, at least one external suction box is provided over a substantially remaining portion of the periphery of the jacket to maintain a minimum vacuum in the radial bores of the suction roll jacket, wherein the outer suction box further provides for one of capturing and leading away of water spray.

43. The suction roll in accordance with claim 13, wherein the support body is arranged to support the suction roll jacket against at least one of a weight of the suction roll jacket, a suction force, a tension force of an outer recirculating belt and an outside pressing force.

44. The suction roll in accordance with claim 13, wherein the support element is comprised of at least one of at least one of a hydrodynamic and a hydrostatic support element.

45. A suction roll for the formation or treatment of a material web comprising:

an outer suction roll jacket comprising a perforated rotating hollow cylinder;

a non-perforated support body arranged to extend through the outer suction roll jacket and to support the outer suction roll jacket at at least one point of its axial extent;

sealing ribs arranged to extend radially between the support body and the suction roll jacket and axially over a full length of the suction roll jacket, whereby the support body is adapted to rotate at a same speed as the suction roll jacket;

the support body comprising an axially extending, through-going bore arranged concentrically with the outer suction roll surface;

an axially extending, rotationally fixed yoke extends through the through-going bore;

the rotationally fixed yoke having two ends which are supported outside of the support body on a frame;

at least one support element arranged to support the support body on the yoke, whereby a bending line of the support body is capable of being influenced; and one of a pressure and vacuum source coupled to at least one non-rotating connection.

* * * * *